US010975557B2

(12) United States Patent
Finkbeiner

(10) Patent No.: US 10,975,557 B2
(45) Date of Patent: Apr. 13, 2021

(54) ODOR REMOVAL DEVICE

(71) Applicant: Bradley Finkbeiner, Kingsley, MI (US)

(72) Inventor: Bradley Finkbeiner, Kingsley, MI (US)

(73) Assignee: Bradley Finkbeiner, Kingsley, MI (US)

( * ) Notice: Subject to any disclaimer, the term of this patent is extended or adjusted under 35 U.S.C. 154(b) by 0 days.

(21) Appl. No.: 16/357,589

(22) Filed: Mar. 19, 2019

(65) Prior Publication Data

US 2019/0292760 A1 Sep. 26, 2019

Related U.S. Application Data

(60) Provisional application No. 62/646,041, filed on Mar. 21, 2018.

(51) Int. Cl.
*E03D 9/05* (2006.01)
*E03D 9/052* (2006.01)

(52) U.S. Cl.
CPC ..... *E03D 9/052* (2013.01)

(58) Field of Classification Search
CPC ..... E03D 9/04; E03D 9/05; E03D 9/052
See application file for complete search history.

(56) References Cited

U.S. PATENT DOCUMENTS 2,100,962 A * 11/1937 Juntunen ..... E03D 9/052 4/213
3,849,808 A * 11/1974 Olson ..... E03D 9/052 4/213
5,345,617 A * 9/1994 Jahner ..... A47K 13/307 4/217
5,491,847 A * 2/1996 Shaffer ..... E03D 9/05 4/213
6,298,500 B1 * 10/2001 Sollami ..... A47K 13/307 4/217
6,363,542 B1 * 4/2002 Pope, Sr. ..... E03D 9/05 4/209 R
2002/0035749 A1 * 3/2002 Prisco ..... E03D 9/05 4/213
2009/0194525 A1 * 8/2009 Lee ..... H05B 3/145 219/553

* cited by examiner

*Primary Examiner* — Janie M Loeppke
(74) *Attorney, Agent, or Firm* — Traverse Legal, PLC

(57) ABSTRACT

An odor removal device for quick and efficient removal of odorous gas from a toilet, without causing the gas to be breathed in by the user of the toilet and without releasing any undesired heat onto the user of the toilet. As the odorous gas is being removed from the toilet by an evacuation assembly, it is transferred to an exhaust fan assembly where it is heated and forced upwards to a ceiling fan. The odorous gas is maintained at an elevated position away from the user of the toilet.

8 Claims, 8 Drawing Sheets

FIG. 4
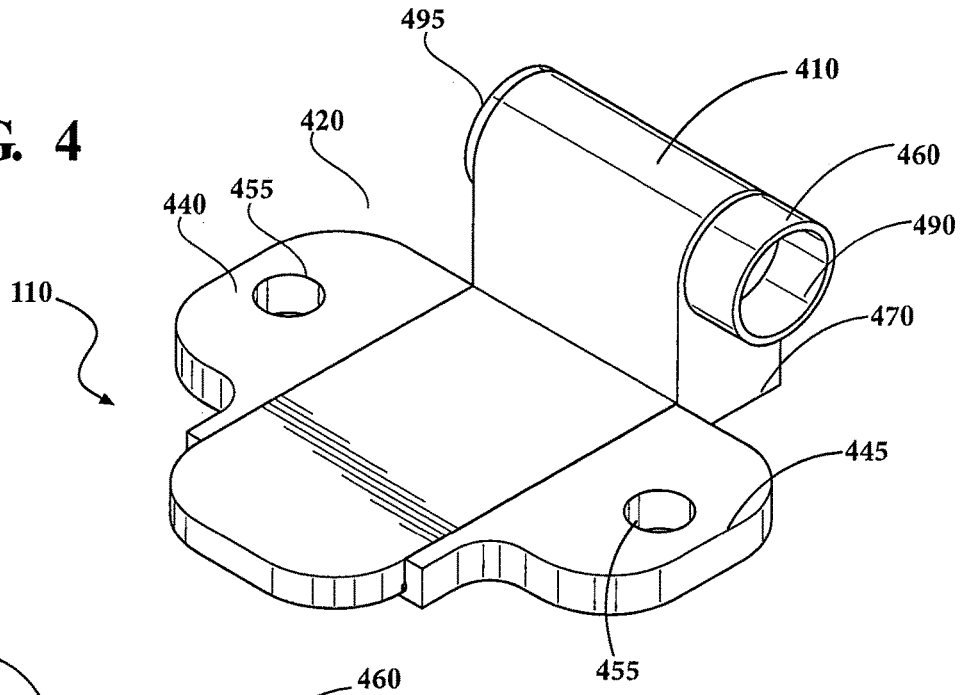
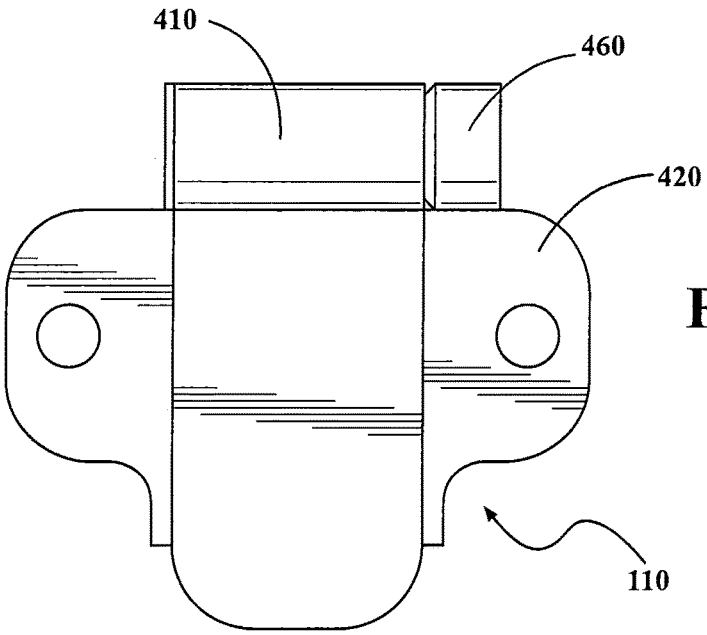
FIG. 5
FIG. 6
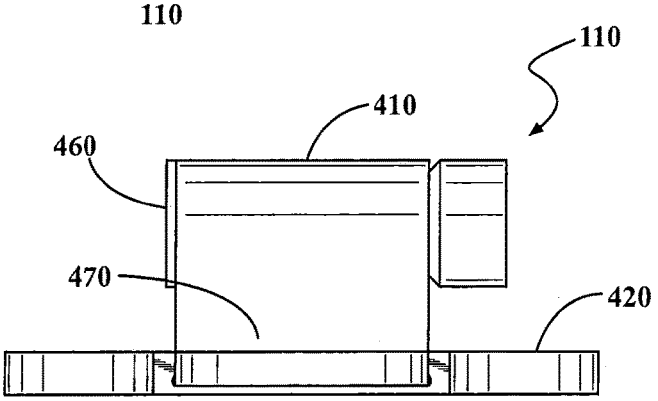

FIG. 12
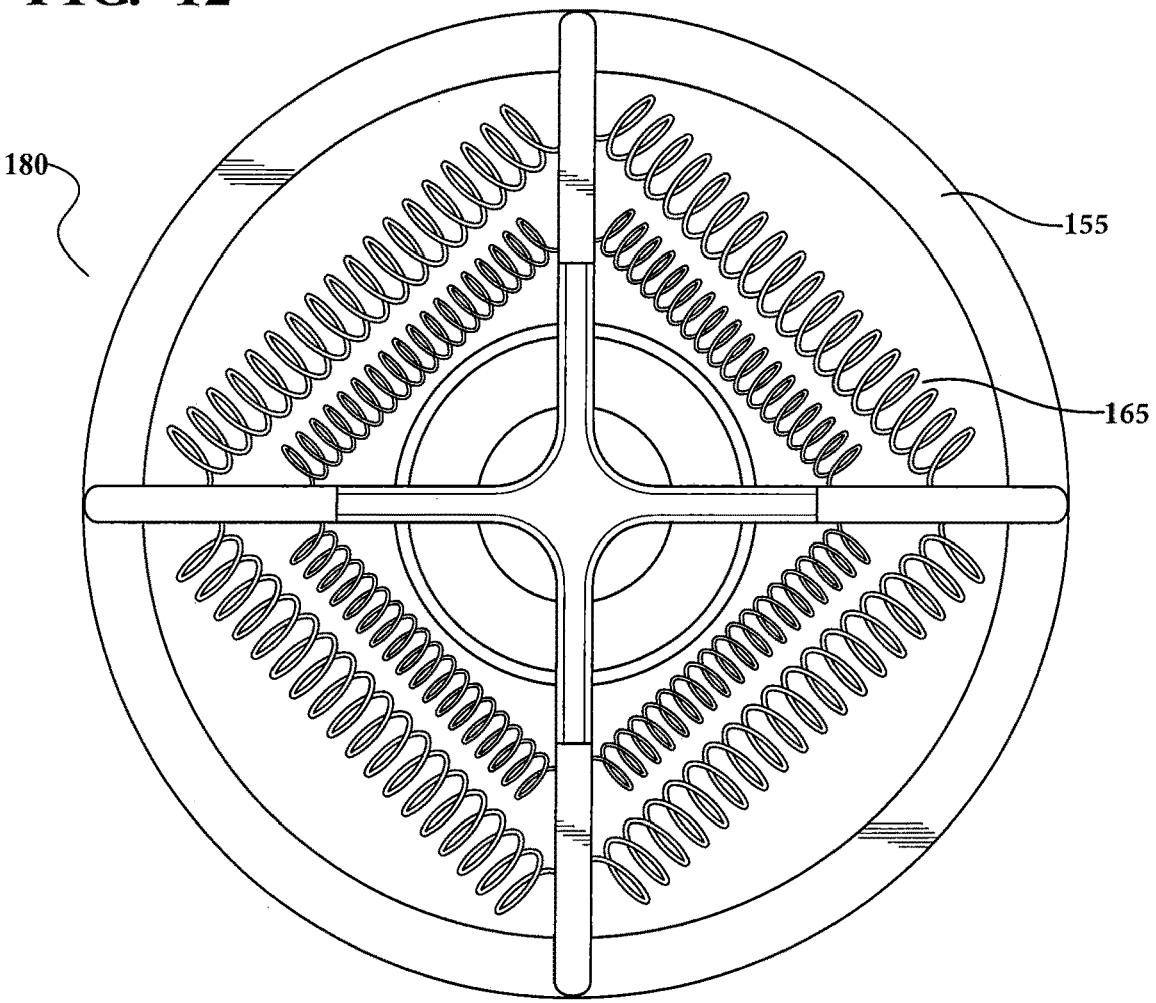
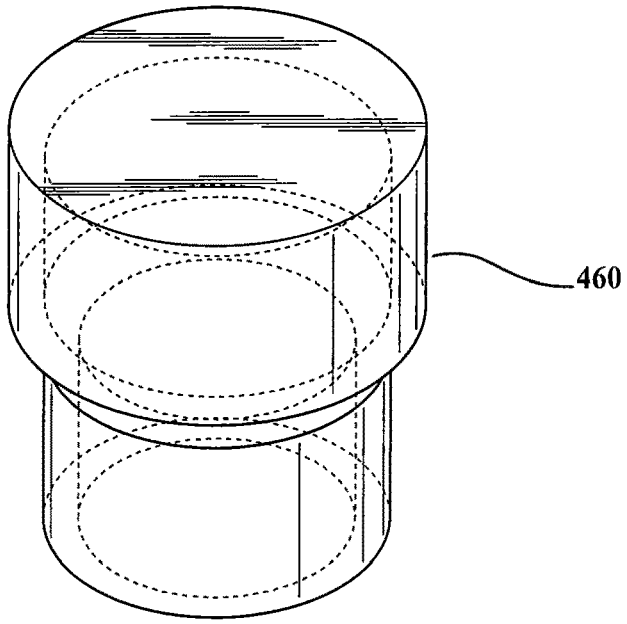
FIG. 13

ODOR REMOVAL DEVICE

PRIORITY CLAIM

This patent application claims priority to and the benefit of the filing date of the provisional patent application having Application No. 62/646,041, filed on Mar. 21, 2018, which is incorporated herein in its entirety.

FIELD

This patent application generally relates to a device for the removal of odor. Specifically, the patent application relates to the removal of unpleasant odor from bathrooms.

BACKGROUND

Removal or diminution of objectionable odors is often desired by users of a toilet since users find such odors particularly concerning. Various devices have been used for removing objectionable bathroom odors, such as ventilation systems (i.e. ceiling fans) and air fresheners. Ventilation systems draw air from the room to exhaust the odors, but the odor particles are often dispersed throughout the room before they can be removed. As a result, these systems cannot remove most of the odor-causing agents from the air and the odorous air is likely to be breathed in by the occupants of the bathroom.

Air fresheners attempt to address odors by spraying chemical into the air or by emitting fragrance from an air freshener placed in the room. However, standard air fresheners only mask unpleasant odors with a more pleasant smelling substance. Since air fresheners do not eliminate the odor at the source, the odor often permeates the room and lingers. There are also different types of deodorizing toilets, such as those that use a carbon filter and those that have a deodorizing toilet seat pad. Often times, these types of deodorizing toilets require bulky attachment components outside the toilet. They also often do not provide an effective means of eliminating foul odors in the bathroom. Some of these deodorizing toilets have lithium ion batteries that can cause fire and need to be regularly replaced.

Consequently, there is a need for a device that efficiently, safely, and comprehensively removes odorous air from the toilet bowl without causing it to be breathed in by bathroom users or without releasing any undesired heat onto occupants of the toilet.

SUMMARY

What is provided is a device for efficiently and removing odorous air from the toilet bowl without releasing any undesired heat onto the occupants of the toilet. In an embodiment, the odor-removal device comprises an evacuation assembly having an upper component attached to a lower component, wherein the lower component is attached to the back side of a toilet bowl of a toilet and a portion of the upper component extends over a portion of the toilet bowl such that the evacuation assembly is configured to draw gas from the toilet bowl, and wherein the upper component has a pair of opposing ends configured to receive and retain a cap. The cap is configured to control the intake of gas into the evacuation assembly from the toilet bowl.

The device also comprises an exhaust fan assembly located remotely from the evacuation assembly, wherein the exhaust assembly is configured to draw up gas from the toilet bowl, to heat the gas, and to force the gas upwards and away from the toilet. The exhaust fan assembly comprises a switch configured to activate and deactivate the exhaust fan assembly; one or more fan blades configured to rotate when the exhaust fan assembly is activated; an electric motor configured to drive the rotation of the one or more fan blades; and a heating element configured to heat the gas in the exhaust fan assembly. The device further comprises a first tube selectively connected to an opening in the cap of the evacuation assembly at one end and to the exhaust fan assembly at another end, wherein the first tube is configured to transfer gas from the evacuation assembly to the exhaust fan assembly.

In some embodiments, the exhaust fan assembly is vertically mounted to a wall and is electrically-powered. In another embodiment, the exhaust fan assembly is coupled to a ceiling fan such that the exhaust fan assembly is activated when the ceiling fan is activated.

In some embodiments, a second tube is selectively connected to the exhaust fan assembly on one end so that gas is transferred upwards from the exhaust fan assembly after the gas has been heated. The first tube and the second tube may each be a pipe, a hose, or a conduit and the second tube is a pipe, a hose, or a conduit.

In some embodiments, the heating element includes carbon diodes and an electric heating coil. In other embodiments, the heating element includes a copper circuit board element.

BRIEF DESCRIPTION OF THE DRAWINGS

Subject matter is particularly pointed out and distinctly claimed in the concluding portion of the specification. Claimed subject matter, however, as to structure, organization and method of operation, together with objects, features, and advantages thereof, may best be understood by reference to the following detailed description if read with the accompanying drawings in which:

FIG. 4 is a schematic perspective view of the evacuation assembly of FIG. 3;

FIG. 5 is a schematic top, plan view of the evacuation assembly of FIGS. 3 and 4;

FIG. 6 is a schematic back elevation view of the evacuation assembly of FIGS. 3-5;

FIG. 12 is a schematic top view of the exhaust fan assembly of FIGS. 10 AND 11; and FIG. 13 is another schematic perspective view of the cap of FIG. 9.

DETAILED DESCRIPTION

In the following detailed description, numerous specific details are set forth in order to provide a thorough understanding of the examples as defined in the claimed subject matter, and as an example of how to make and use the examples described herein. However, it will be understood by those skilled in the art that claimed subject matter is not intended to be limited to such specific details, and may even be practiced without requiring such specific details. In other instances, well-known methods, procedures, and ingredients have not been described in detail so as not to obscure the invention defined by the claimed subject matter.

Throughout this specification, the term "system" may, depending at least in part upon the particular context, be understood to include any method, process, apparatus, and/or other patentable subject matter that implements the subject matter disclosed herein.

Figure 1:
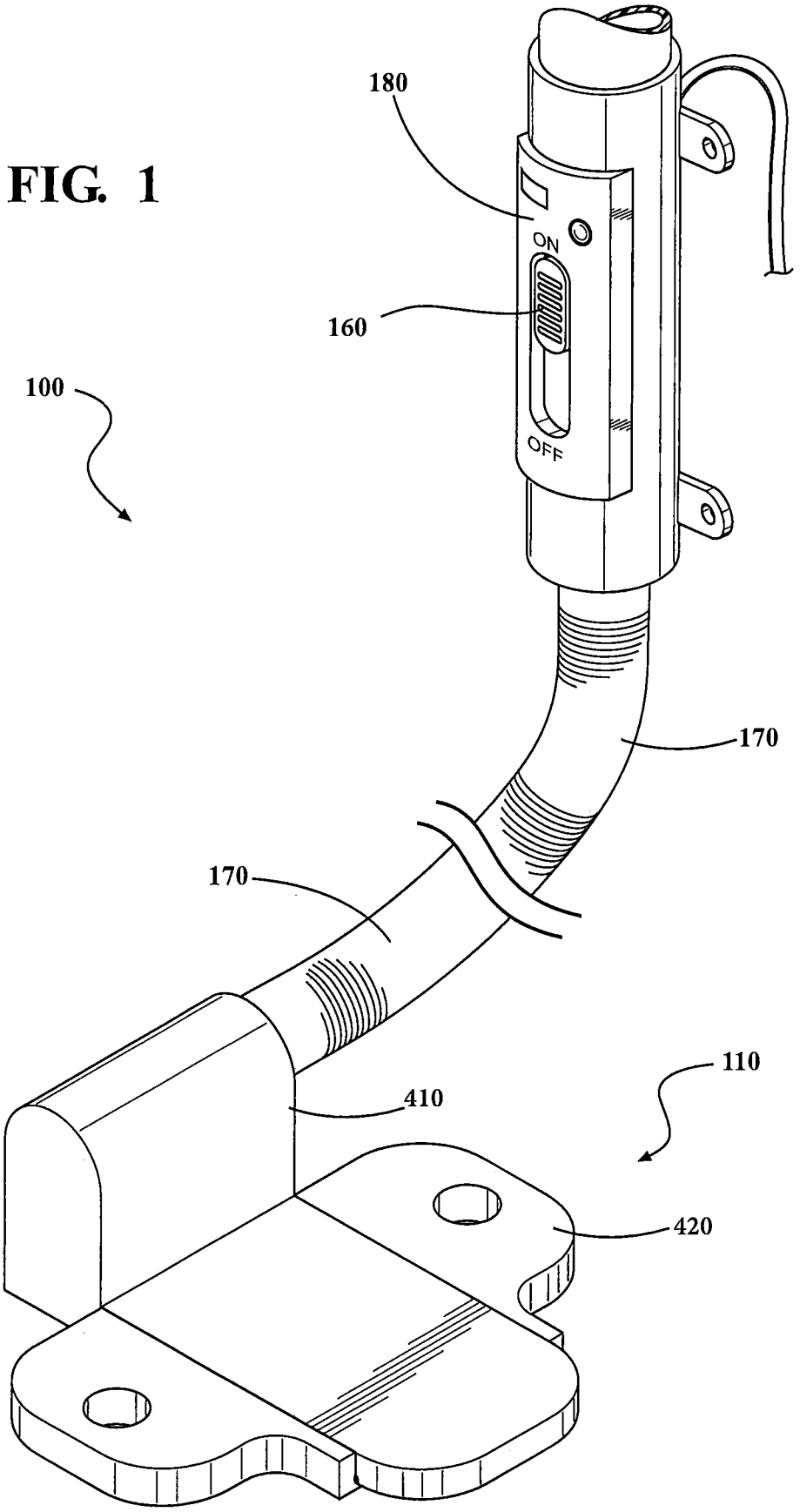
FIG. 1 is a schematic perspective view of an exemplary odor removal device.
Figure 2:
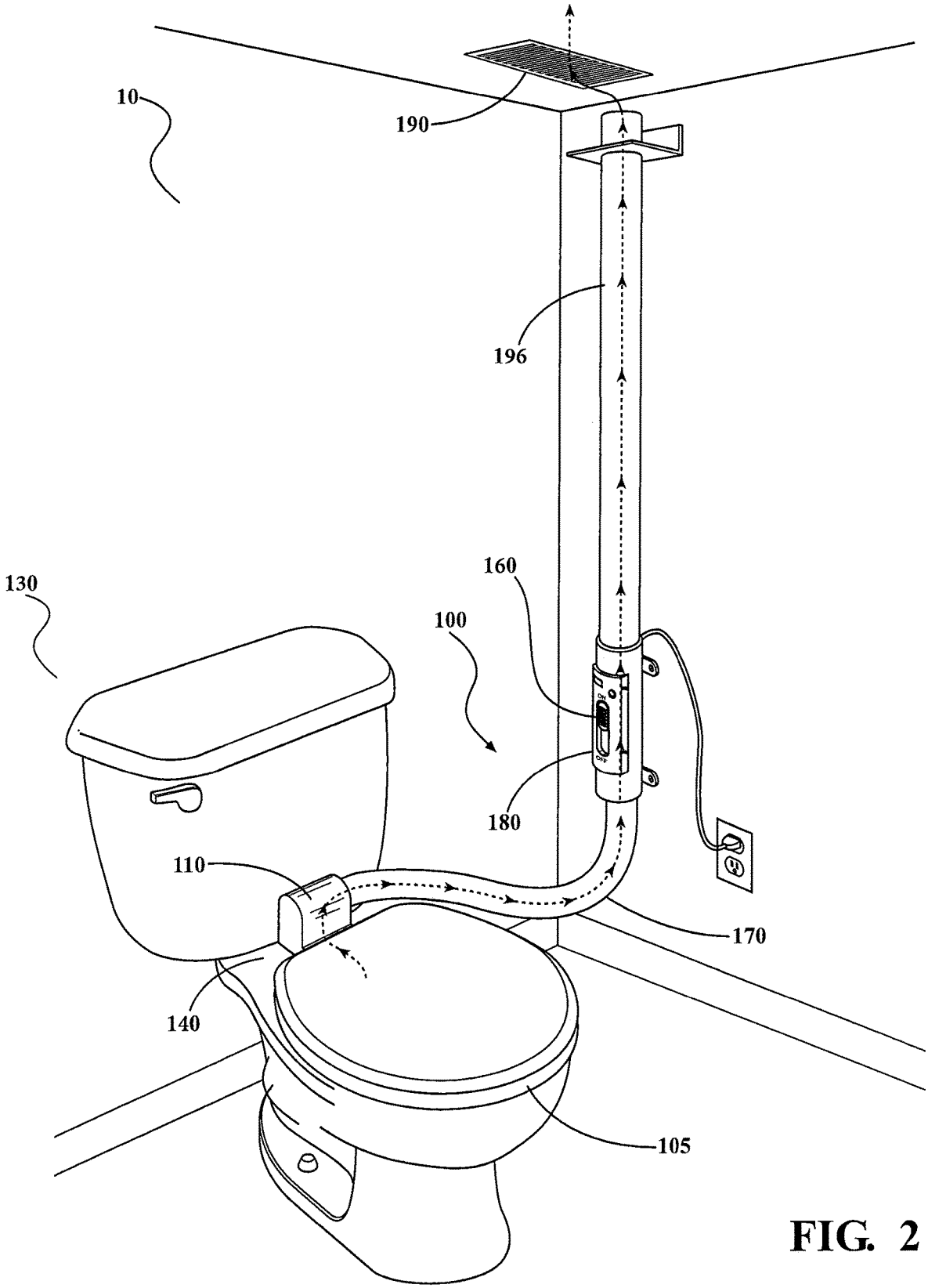
FIG. 2 is a schematic perspective view of an exemplary system comprising the odor removal device of FIG. 1.
Figure 3:
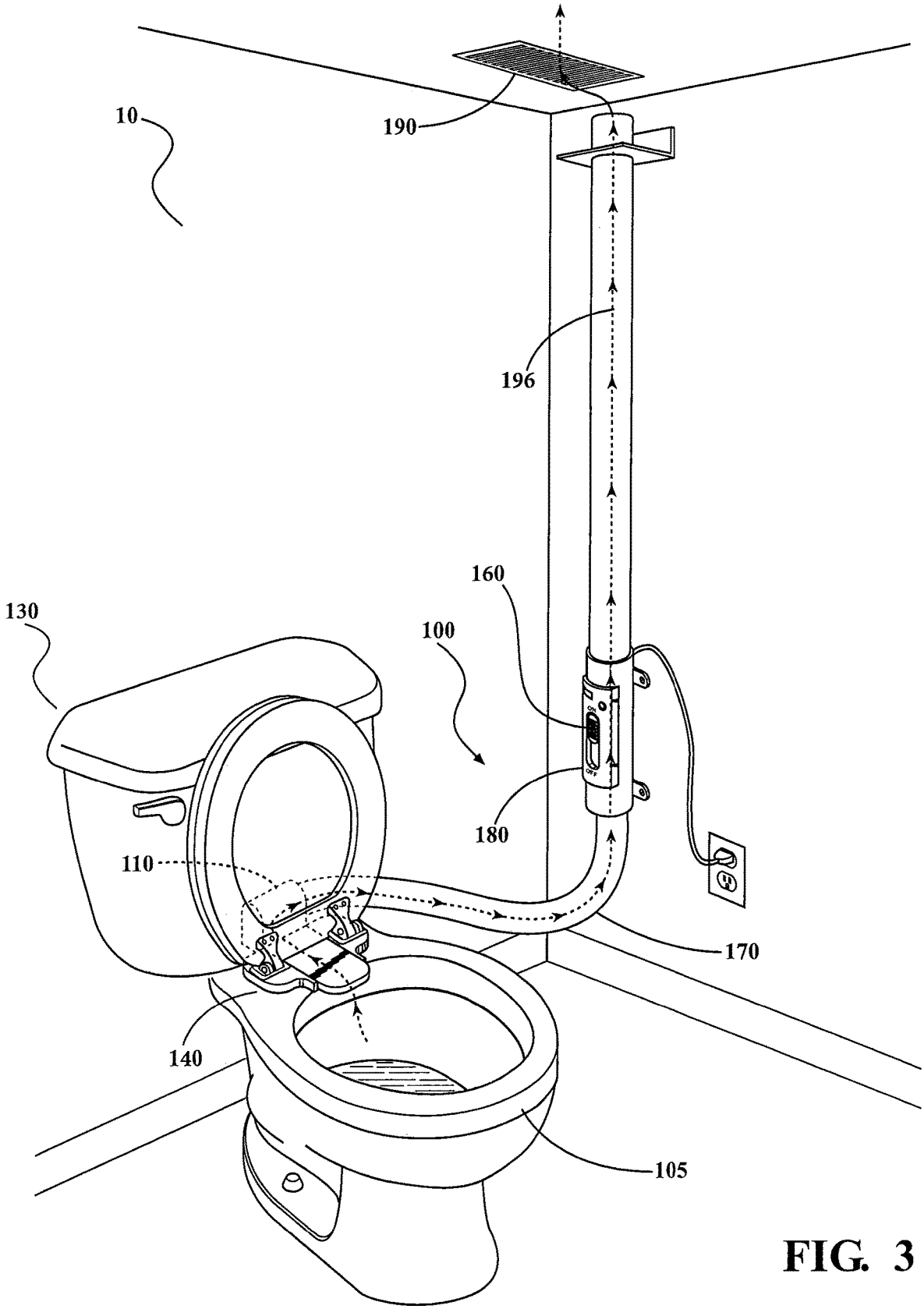
FIG. 3 is another schematic perspective of the system of FIG. 2, illustrating an evacuation assembly on a toilet bowl.

FIGS. 1-3 are schematic perspective views of an exemplary odor removal device 100 as a part of an exemplary system 10 disclosed herein. As a non-limiting example, the device 100 comprises an evacuation assembly 110 and a first tube 170, wherein the first tube 170 is connected at one end to the evacuation assembly 110 and at the other end to an exhaust fan assembly 180. The first tube 170 may be made of an elastomeric material. In some embodiments, the first tube 170 is a hose, a pipe, a conduit, or the like designed to carry gas/air from one location to another within the device 100.

Upon insertion of the first tube 170 into the evacuation assembly 110, gas/air may be transferred from a standard gravity fed toilet 130 to the exhaust fan assembly 180, which may be located remotely from the toilet 130. FIG. 2 shows the path of air flow from the toilet 130 to the evacuation assembly 110, through the first tube 170, and into the exhaust fan assembly 180. The air/gas is then heated by the exhaust fan assembly 180 and then propelled towards a ceiling fan 190 in a bathroom for removal from the bathroom, as indicated by the arrows in FIG. 2.

The evacuation assembly 110 may be attached to a rear side 140 of a toilet bowl 105 in the toilet 130, as shown in FIG. 2. In a non-limiting example, the evacuation assembly 110 may be securely attached to the rear side 140 of the toilet bowl 105 through the use of mechanical fasteners, such as screws, so that the evacuation assembly 110 is substantially flat. The evacuation assembly 110 may be positioned on the toilet 130 such that a portion of the evacuation assembly 110 extends over a portion of the toilet bowl 105, but not so far as to limit the ability of the toilet seat and cover to be readily opened and shut. The evacuation assembly 110 may be made of plastic, metal, or any other material suitable for use on the toilet 130.

As best shown in FIGS. 4-6, the evacuation assembly 110 includes an upper component 410 that may be integrally connected to at least a portion of a lower component 420. Once assembled, the evacuation assembly 110 may be of a size and shape to attach in a substantially flat orientation to the rear side 140 of the toilet bowl 105 and to at least partially extend over a portion of the toilet bowl 105.

Figure 7:
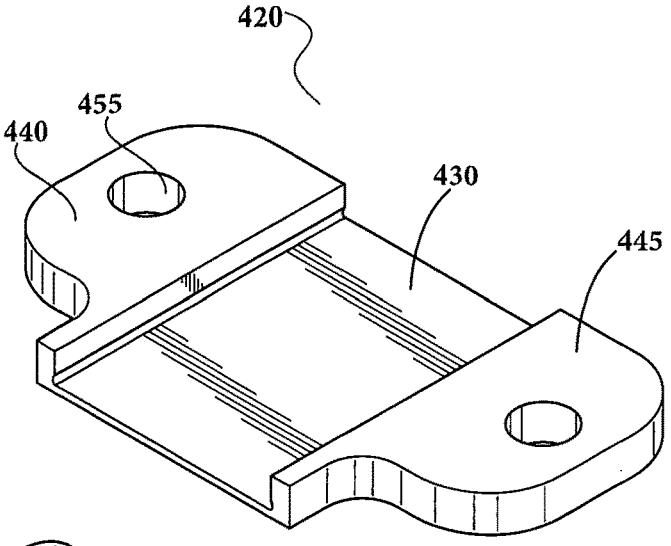
FIG. 7 is a schematic perspective view of the lower component of the evacuation assembly of FIGS. 3-6.

As best shown in FIG. 7 and as a non-limiting example, the lower component 420 may have a first side segment 440 and a second side segment 445, wherein the first side segment 440 is a mirror-image of the second side segment 445. Each of the first side segment 440 and the second side segment 445 includes one or more apertures 455. The one or more apertures 455 may be of a size and shape to receive and/or retain at least a portion of one or more mechanical fasteners used to attach the evacuation assembly 110 to the rear side 140 of the toilet bowl 105. When installed on the toilet bowl 105, the first side segment 440 and the second side segment 445 may curve around toilet bowl caps concealing the toilet bowl bolts.

A third segment 430 on the lower component 420 is interposed between the first side segment 440 and the second side segment 445. The third segment 430 is substantially flat and indented within the lower component 420, such that the first side segment 440 and the second side segment 445 have a greater thickness than the thickness of the third segment 430. In some embodiments, the third segment 430 may have a thickness of about 3 inches, while each of the first side segment 440 and the second side segment 445 may have a thickness of about 5.5 inches. The third segment 430 is configured to provide an attachment area for the upper component 410 to securely and readily attach to the lower component 420. The upper component 410 may be selectively snapped into the lower component 420 to allow for easy cleaning and maintenance of both the upper component 410 and the lower component 420.

Figure 8:
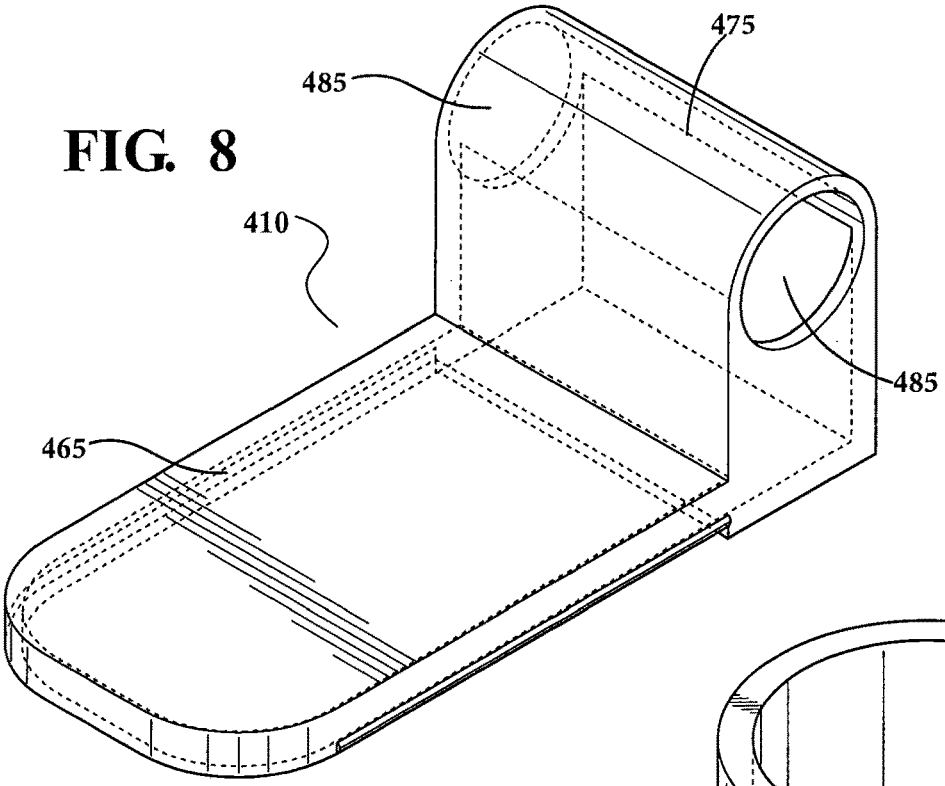
FIG. 8 is a schematic perspective view of the upper component of the evacuation assembly of FIGS. 3-6.

As best shown in FIG. 8, the upper component 410 comprises a substantially flat and rectangular first portion 465 that is configured to attach directly to the top of the third segment 430. As best seen in FIGS. 2 and 3, the first portion 465 may extend outward over a portion of the toilet bowl 105. The first portion 465 may be integrally attached to a second portion 475.

The second portion 475 of the upper component 410 may have a substantially vertical back wall 470 that is perpendicular to the first portion 465. As best seen in FIG. 8 and as a non-limiting example, the second portion 475 may also include a pair of substantially circular, opposing ends 485. The opposing ends 485 may be of a size and shape to receive and/or retain a cap 460.

Figure 9:
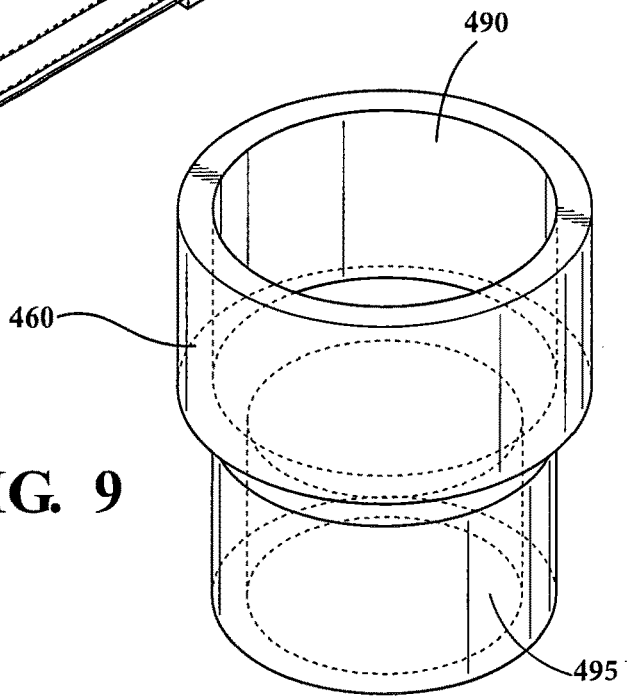
FIG. 9 is a schematic perspective view of an exemplary cap of the evacuation assembly of FIGS. 3-6.

The cap 460 may be selectively inserted into one of the pair of opposing ends 485 of the second portion 475. As best shown in FIGS. 9 and 13 and as a non-limiting example, the cap 460 may have a substantially cylindrical shape and may have a first end 490 and a second end 495. The first end 490 has an opening that may be of a size and shape to receive and/or retain the first tube 170. The second end 495 may be closed in order to retain the first tube 170 in the cap 460 and to prevent any gas or fluid from inadvertently escaping. The cap 460 is operably configured to control whether any air is drawn from the toilet 130 through the evacuation assembly 110. The first end 490 may be located on either the left side or the right side of the toilet 130 based on the preference of the user and whether the user is right-handed or left-handed. As a result, the second end 495 will be located on the opposite side of the toilet 130 as the first end 490.

In operation of the system 10, the exhaust fan assembly 180 is configured to help draw the air from the toilet 130, to heat the air, and to force/blow the air out of the bathroom and away from the user. As such, odorous air from the toilet 130 can be forced away from any occupants of the bathroom. As best shown in FIGS. 2 and 3 and as a non-limiting example, the exhaust fan assembly 180 may be mounted/secured to a wall in the bathroom and may be electrically-operated by being plugged into an outlet in the bathroom or the bathroom ceiling fan 190. In this example, the exhaust fan assembly 180 may be mounted/secured to a bathroom wall in any manner such that the exhaust fan assembly 180 is stable and secure during operation.

As best shown in FIGS. 2 and 3 and as a non-limiting example, a second tube 196 may be selectively attached to the upper portion of the exhaust fan assembly 180 to further promote the flow of air upwards and out of the bathroom. In some embodiments, the second tube 196 is a hose, a pipe, a conduit, or the like designed to carry gas/air from one location to another within the device 100. In an embodiment, the second tube 196 may be coupled directly to the bathroom ceiling fan 190 by being run through the inside of the exhaust fan assembly 180. In another embodiment, the second tube 196 may be in close proximity with the bathroom ceiling fan 190 to effectively force the air out of the bathroom. Thus, an external power source is optional.

In some embodiments, the exhaust fan assembly 180 is mounted in a vertical orientation facing upwards toward a bathroom ceiling fan 190 in order to help guide the flow of air, particularly odorous air from the toilet, out through the bathroom ceiling fan 190. Bathroom ceiling fans have mounting ports/holes through which the odorous air from the toilet can be specifically guided for removal from the bathroom. In these embodiments, the exhaust fan assembly 180 is in direct communication with the bathroom ceiling fan 190 such that turning on the bathroom ceiling fan 190 initiates activation of the exhaust fan assembly 180. In other embodiments, odor from the toilet may exit the bathroom through an outside wall or through an interior wall having an attic space.

Figure 10:
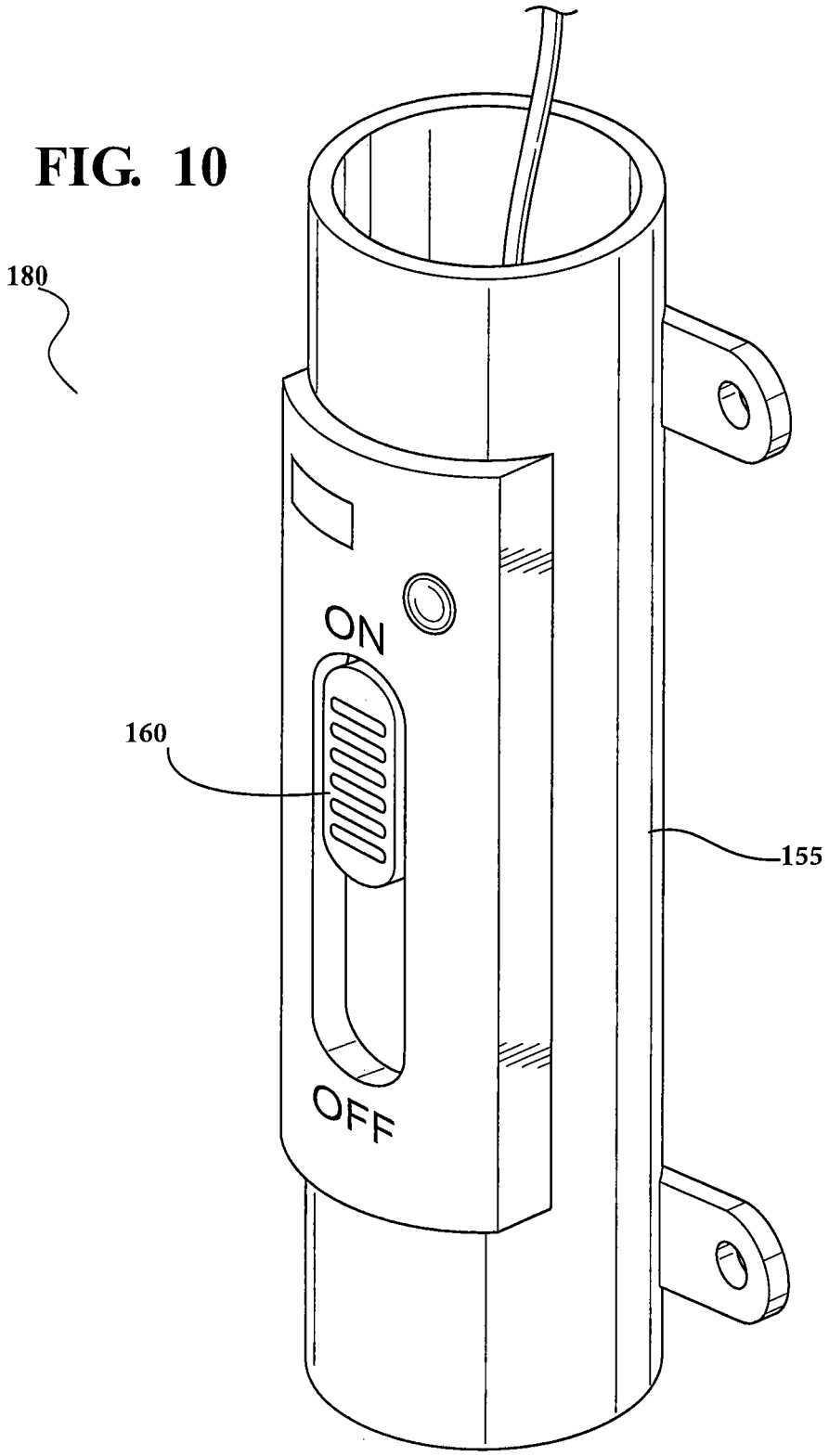
FIG. 10 is a schematic perspective view of the exterior of an exemplary exhaust fan assembly.

Referring to FIG. 10, FIG. 10 shows a schematic perspective view of the exterior of the exhaust fan assembly 180 having an on-off switch 160. Even though the exhaust fan assembly 180 may be activated in response to activation of the bathroom ceiling fan 190, an occupant of the bathroom may manually turn the exhaust fan assembly 180 either on or off using the on-off switch 160 depending on the desired circumstances. As best shown in FIG. 10 and as a non-limiting example, the on-off switch 160 may be securely attached to the exhaust fan assembly 180 through the use of screws and mounting brackets. Air intake into the exhaust fan assembly 180 occurs through the bottom of the exhaust fan assembly 180 due to air flow through the tube 170. After being heated, the air is pushed through the top of the exhaust fan assembly 180. The air then continues upward toward the bathroom ceiling fan 190.

In some embodiments, the exhaust fan assembly 180 is configured to receive a schedule 40 1.5 inch pipe. In this embodiment, the diameter of the exhaust fan assembly 180 on the exhaust side is about 1.5 inches and the diameter of the exhaust fan assembly 180 on the intake side is about 1.75 inches. This embodiment of the exhaust fan assembly 180 allows for the accommodation of readily available materials, such as a schedule 40 pipe.

Figure 11:
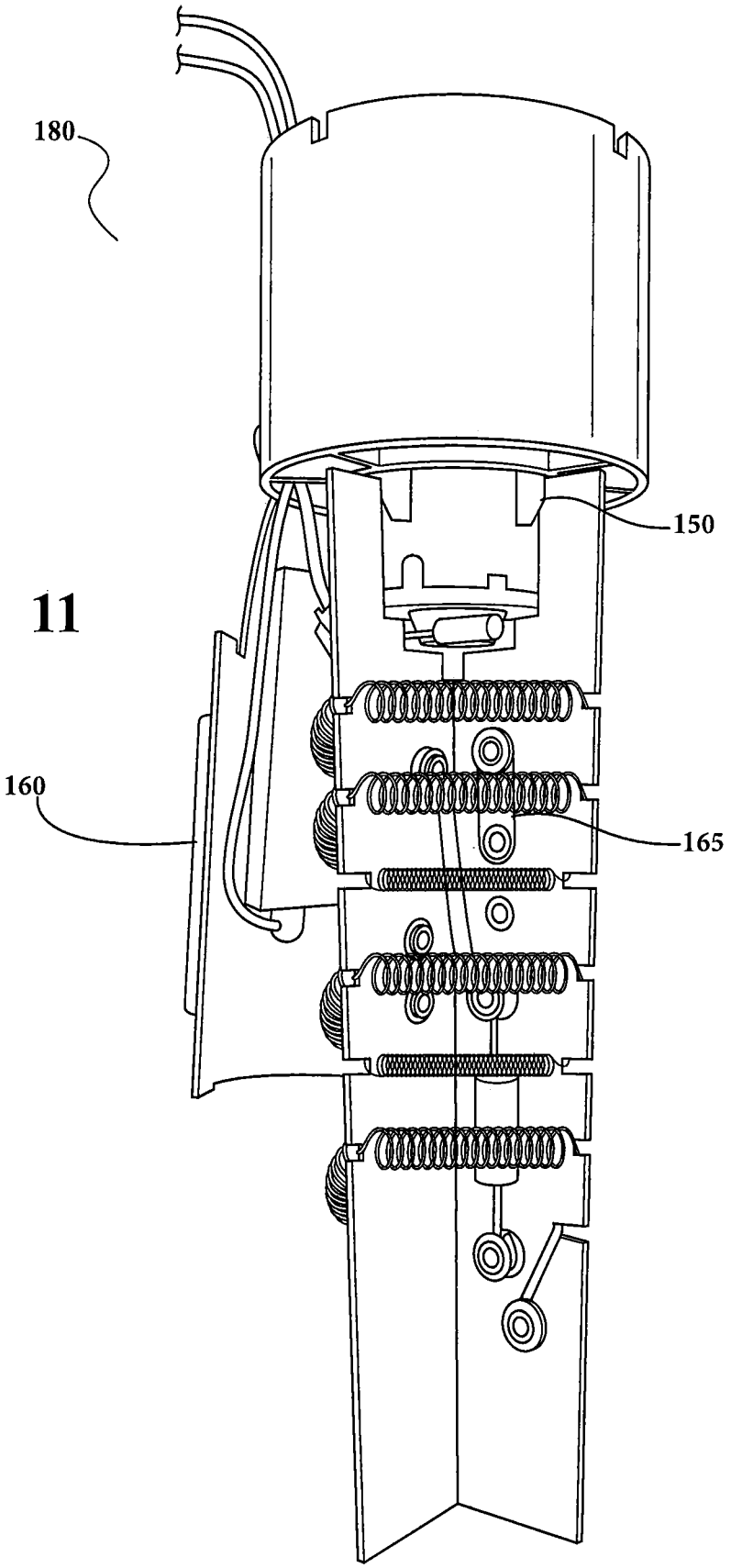
FIG. 11 is a schematic perspective view of the interior of the exhaust fan assembly of FIG. 10.

Referring to FIG. 11, FIG. 11 shows a schematic perspective view of the interior of the exhaust fan assembly 180. The exhaust fan assembly 180 includes an outer casing 155 made of plastic that is coupled to the on-off switch 160. The exhaust fan assembly 180 may further include one or more fan blades 150 and a heating element 165. Incoming airflow is pulled into the exhaust fan assembly 180 through the tube 170 due to the vacuum effect created by the rotation of the one or more fan blades 150. An electric motor within the outer casing 155 may be responsible for driving the one or more blades 150.

In some embodiments, the exhaust fan assembly 180 may be set to a low setting and may not adjust itself to the air intake received from the evacuation assembly 110. In some embodiments, the heating element 165 has one speed and one level of heat. In some embodiments, the heating element 165 may comprise carbon diodes and an electric heating coil. In other embodiments, the heating element 165 may comprise a copper circuit board element. In yet other embodiments, the heating element 165 may comprise commercially available stainless steel.

The heating element 165 may be configured to heat the air in the exhaust fan assembly 180 in order to expedite the rising of the air and to maintain the elevated air in order to force it through the bathroom ceiling fan 190. In order to make the air rise and keep it elevated, the difference between the temperature of the air in the toilet bowl 105 and the air in the bathroom ceiling fan 190 may be between about 25 and 30 degrees Fahrenheit. The actual temperature of the air leaving the exhaust fan assembly 180 and traveling to the bathroom ceiling fan 190 may be between about 125 and 150 degrees Fahrenheit. The temperature of the heated air may depend on the type of bathroom ceiling fan 190, the ceiling tower, and the riser vent. In some embodiments, the heated air may need to rise at least about 6 feet above the toilet 130.

Referring to FIG. 12, FIG. 12 shows a schematic top view of the exhaust fan assembly 180 of FIG. 10. The outer casing 155 may include a liner made of fiber material that is heat/fire retardant to ensure that the plastic doesn't overheat. If the plastic begins to overheat in the exhaust fan assembly 180, a thermocouple (not shown) can shut off power entirely to the exhaust fan assembly 180. Alternatively, the exhaust fan assembly 180 may be turned off by turning the on-off switch 160 to the "off" setting.

The application of the odor removal device 100 disclosed herein to standard toilets allows for the quick and efficient removal of odorous air from the toilet bowl 105 without causing it to be breathed in by bathroom users. In addition, the separation of the exhaust fan assembly 180 from the toilet 130 ensures that bathroom users will not be exposed to any undesired heat. As the odorous air is being removed from the toilet and pass to the exhaust fan assembly 180, it is heated to expedite its rise towards the bathroom ceiling fan 190 and maintenance at an elevated position.

It will, of course, be understood that, although particular examples have just been described, the claimed subject matter is not limited in scope to a particular example or limitation. Likewise, an example may be implemented in any combination of compositions of matter, apparatuses, methods or products made by a process, for example.

In the preceding description, various aspects of claimed subject matter have been described. For purposes of explanation, specific numbers, percentages, components, ingredients and/or configurations were set forth to provide a thorough understanding of claimed subject matter. However, it should be apparent to one skilled in the art having the benefit of this disclosure that claimed subject matter may be practiced without the specific details. In other instances, features that would be understood by one of ordinary skill were omitted or simplified so as not to obscure claimed subject matter. While certain features and examples have been illustrated or described herein, many modifications, substitutions, changes or equivalents will now occur to those skilled in the art. It is, therefore, to be understood that the appended claims are intended to cover all such modifications or changes as fall within the true spirit of claimed subject matter.

What is claimed is:

1. An odor-removal device comprising:

an evacuation assembly operably configured to draw gas from a toilet bowl on a toilet, wherein the evacuation assembly comprises:

an upper component extending at least partially over an opening defined by the toilet bowl, wherein the upper component includes a pair of opposing ends configured to receive and retain a cap, wherein the cap is configured to control the intake of gas into the evacuation assembly from the toilet bowl; and a lower component attached to the upper component, wherein the lower component is attached to the back side of the toilet bowl;

an exhaust fan assembly disposed remotely from the evacuation assembly and the toilet, wherein the exhaust fan assembly is configured to remove gas in a one-way directional flow upward and away from the toilet, the exhaust fan assembly comprises:

an outer casing;

a switch coupled to the outer casing and configured to activate and deactivate the exhaust fan assembly;

one or more fan blades housed within the outer casing, wherein the fan blades are configured to rotate when the exhaust fan assembly is activated;

an electric motor configured to drive the rotation of the one or more fan blades; and a heating element housed within the outer casing and configured to heat the gas in the exhaust fan assembly;

a first tube selectively connected to an opening in the cap of the evacuation assembly at one end and to the exhaust fan assembly at another end, wherein the first tube is configured to transfer gas from the evacuation assembly to the exhaust fan assembly; and a second tube selectively connected to the exhaust fan assembly at one end and to a ceiling fan at another end, wherein the second tube is configured to transfer gas upward from the exhaust fan assembly after the gas has been heated.

2. The odor-removal device of claim 1, wherein the lower component of the evacuation assembly comprises one or more apertures.

3. The odor-removal device of claim 1, wherein the exhaust fan assembly is vertically mounted to a wall and is electrically-powered.

4. The odor-removal device of claim 1, wherein the lower component has a first segment, an opposing second segment, and a third segment interposed between the first and second segments, wherein the third segment has a smaller thickness than the thickness of the first and second segments.

5. The odor-removal device of claim 1, wherein the first tube is a pipe, a hose, or a conduit and the second tube is a pipe, a hose, or a conduit.

6. The odor-removal device of claim 1, wherein the heating element includes an electric heating coil.

7. The odor-removal device of claim 1, wherein the gas leaving the exhaust fan assembly has a temperature about 25-30 degrees F. higher than the temperature of the gas entering the exhaust fan assembly.

8. An odor-removal device comprising:

an evacuation assembly operably configured to draw gas from a toilet bowl on a toilet, wherein the evacuation assembly comprises:

an upper component extending at least partially over an opening defined by the toilet bowl, wherein the upper component includes a pair of opposing ends configured to receive and retain a cap, wherein the cap is configured to control the intake of gas into the evacuation assembly from the toilet bowl; and a lower component attached to the upper component, wherein the lower component is attached to the back side of the toilet bowl;

an exhaust fan assembly disposed remotely from the toilet and mounted to a wall, wherein the exhaust fan assembly is plugged into an outlet on the wall, and wherein the exhaust fan assembly is configured to remove gas in a one-way directional flow upward and away from the toilet, the exhaust fan assembly comprises:

a switch configured to activate and deactivate the exhaust fan assembly;

one or more fan blades configured to rotate when the exhaust fan assembly is activated;

an electric motor configured to drive the rotation of the one or more fan blades; and a heating element configured to heat the gas in the exhaust fan assembly;

a first tube selectively connected to an opening in the cap of the evacuation assembly at one end and to the exhaust fan assembly at another end, wherein the first tube is configured to transfer gas from the evacuation assembly to the exhaust fan assembly; and a second tube selectively connected to the exhaust fan assembly at one end and to a ceiling fan at another end, wherein the second tube is configured to transfer gas upward from the exhaust fan assembly after the gas has been heated.

* * * * *